United States Patent [19]

Daman et al.

[11] 4,177,858

[45] Dec. 11, 1979

[54] HEAT EXCHANGER

[75] Inventors: Ernest L. Daman, Westfield; Robert A. McCallister, Mountain Lakes, both of N.J.

[73] Assignee: Foster Wheeler Energy Corporation, Livingston, N.J.

[21] Appl. No.: 826,602

[22] Filed: Aug. 22, 1977

[51] Int. Cl.[2] ..... F28D 15/00; F28F 11/00

[52] U.S. Cl. ..... 165/11; 165/70; 165/105

[58] Field of Search ..... 165/11, 70, 105

[56] References Cited

U.S. PATENT DOCUMENTS 2,937,923 5/1960 Shapleigh ..... 165/70 X

FOREIGN PATENT DOCUMENTS 320698 12/1971 U.S.S.R. ..... 165/70

*Primary Examiner*—Albert W. Davis, Jr.

*Attorney, Agent, or Firm*—Marvin A. Naigur; John E. Wilson; John J. Herguth, Jr.

[57] ABSTRACT

A heat exchanger is provided having first and second fluid chambers for passing primary and secondary fluids. The chambers are spaced apart and have heat pipes extending from inside one chamber to inside the other chamber. A third chamber is provided for passing a purge fluid, and the heat pipe portion between the first and second chambers lies within the third chamber.

8 Claims, 4 Drawing Figures

FIG. 2
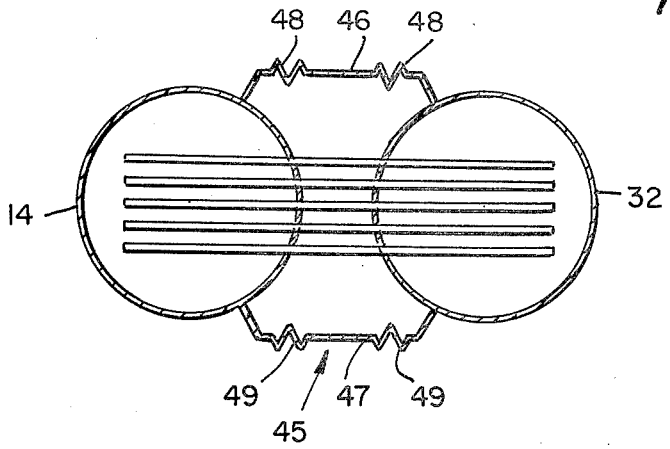
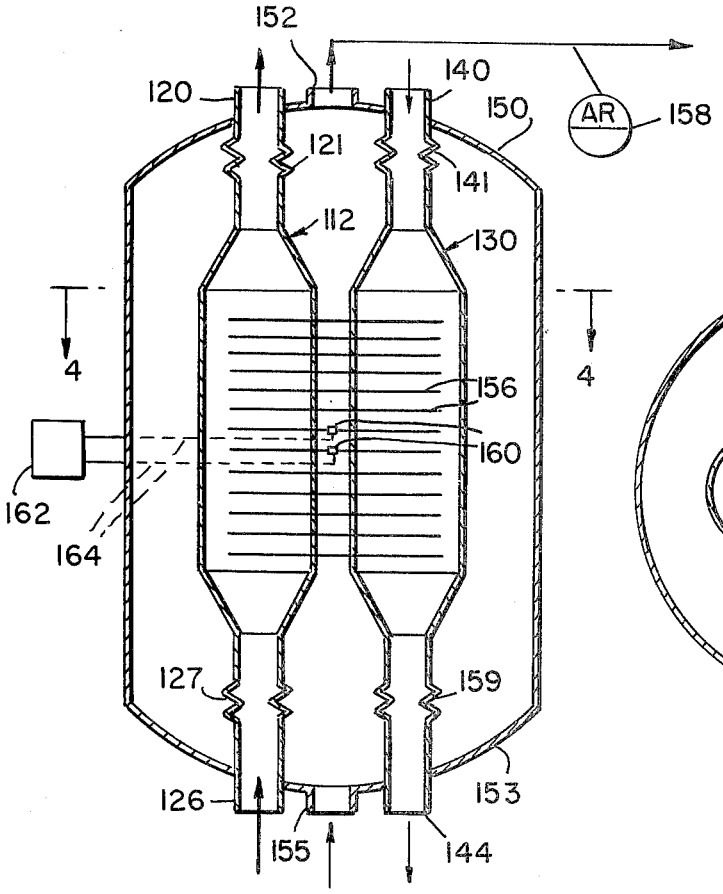
FIG. 3
FIG. 4
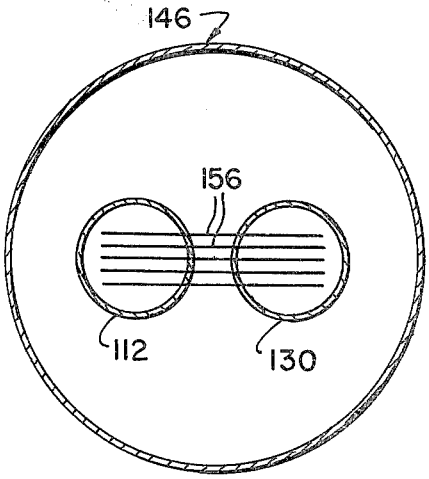

HEAT EXCHANGER

BACKGROUND OF THE INVENTION

This invention relates to heat exchangers, and particularly to heat exchangers through which different fluids are passed, which if coming in contact with each other could result in fire, explosion or contamination of the fluids.

In many cases it is desirable to recover heat generated in a given process in order to improve the efficiency of the process. An example of such heat recovery would be the preheating of an air charge in a coal gasification process. Preheating can be accomplished by heat exchange in a conventional shell and tube heat exchanger. However, since the air could be at a higher pressure than the combustible process gas, any leakage could result in fire or explosion. In order to preclude the possibility of such a hazard, it becomes necessary to separate the fluids. Furthermore, in order to detect leakage of either fluid, which might escape to surrounding areas, means for detecting leakage is required.

In accordance with the present invention, the danger of violent reaction of the fluids has been alleviated by passing the fluids through different chambers, and providing for heat exchange through the use of heat pipes extending through each chamber. Leakage of either fluid can be detected through the use of a third chamber provided for passing a purge fluid. Means are provided for detecting leakage of either fluid in the purge fluid.

SUMMARY OF THE INVENTION

In accordance with an illustrative embodiment demonstrating features and advantages of the present invention, there is provided a heat exchanger including a first fluid chamber for flowing a primary fluid therethrough. A second fluid chamber for flowing a secondary fluid therethrough is spaced apart from the first chamber. A heat pipe extends from inside the first fluid chamber to inside the second fluid chamber, with a portion being intermediate the chambers. A third fluid chamber is provided for flowing a purge fluid, with the intermediate portion of the heat pipe lying within the third chamber. Means are provided for detecting leakage of primary or secondary fluid into the third chamber, by analyzing the purge fluid.

BRIEF DESCRIPTION OF THE DRAWINGS

The above brief description, as well as further objects, features, and advantages of the present invention, will be more fully appreciated by referring to the following description of a presently preferred but nonetheless illustrative embodiment in accordance with the present invention when taken in connection with the accompanying drawings wherein:

FIG. 2 is a sectional plan view of the heat exchanger of FIG. 1 taken along line 2—2 of FIG. 1 showing the chambers of the heat exchanger;

FIG. 3 is an elevational cross-sectional view of an alternative embodiment of the heat exchanger of the present invention showing the heat pipes within the chambers of the heat exchanger; and FIG. 4 is a sectional plan view of the heat exchanger of FIG. 3 taken along line 4—4 of FIG. 3, showing the chambers of the heat exchanger.

DESCRIPTION OF THE PREFERRED EMBODIMENT

Figure 1:
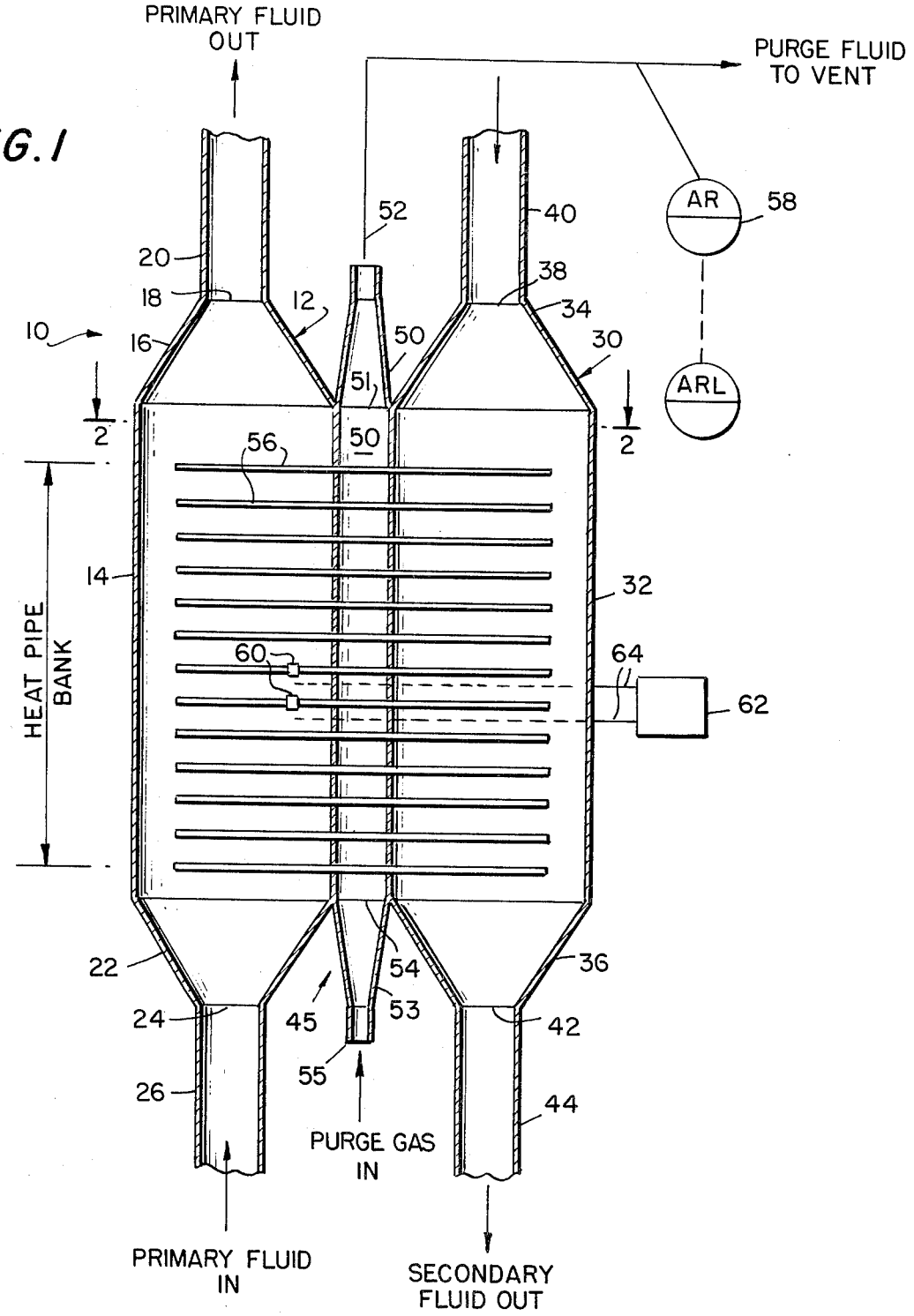
FIG. 1 is an elevational cross-sectional view of the heat exchanger of the present invention showing the heat pipes within the chambers of the heat exchanger.

Referring to FIG. 1 of the drawings, there is illustrated a heat exchanger which is generally designated by the reference numeral 10. The heat exchanger 10 includes a first chamber 12 defined by a generally cylindrical wall 14 for passing a primary fluid at a given temperature. Chamber 12 has a top closure 16 secured to wall 14. Closure 16 has an opening 18 communicating with an outlet pipe 20 for removing primary fluid from first chamber 12. At its lower end chamber 12 has a bottom closure 22 which has an opening 24 communicating with inlet pipe 26 for supplying primary fluid to chamber 12.

Heat exchanger 10 also includes a second chamber 30 for passing a secondary fluid at a temperature different from that of the primary fluid. Chamber 30 includes a generally cylindrical wall 32, and has a top closure 34 and bottom closure 36 similar to those of the first chamber 12. Top closure 34 has an opening 38 communicating with inlet pipe 40 for supply of secondary fluid to the second chamber 30. Bottom closure 36 has an opening 42 communicating with outlet pipe 44 for removing secondary fluid from the second chamber 30.

It is to be understood that while first chamber 12 and second chamber 30 are shown as being generally cylindrical, having circular cross sections, these chambers can be of different shapes, such as rectangular in cross section.

Additionally, while the direction of the flow paths of primary fluid and secondary fluid through first chamber 12 and second chamber 30 respectively is shown as being in opposite directions, it is to be understood that the flow paths of each fluid need not be in opposite directions.

Disposed between first chamber 12 and second chamber 30, there is shown an intermediate chamber 45 for passing a purge fluid which can be analyzed to detect leakage of primary or secondary fluid into the intermediate chamber 45. Chamber 45 is defined by opposing walls 46 and 47, rigidly secured to walls 14 and 32 of first chamber 12 and second chamber 30 respectively, as shown in FIG. 2. Walls 46 and 47 have expansion sections 48 and 49 respectively which act to absorb stresses in walls 46 and 47 which may result from the temperature difference between the primary and secondary fluids.

Intermediate chamber 45 includes a top closure 50 having an opening 51 communicating with vent line 52. At its lower end chamber 45 has a bottom closure 53 having an opening 54 communicating with purge fluid supply pipe 55.

Also shown in FIG. 1 are heat pipes 56 which extend from inside first chamber 12, through intermediate chamber 45, and into second chamber 30. These heat pipes are of a known design and consist basically of a closed chamber whose inside walls are covered with a capillary structure, or wick. A thermodynamic working fluid having a substantial vapor pressure at a desired temperature of operation saturates the pores of the wick.

It is to be understood that the heat pipes 56 can be arranged in stages from the top to the bottom of the heat exchanger 10, with different stages including heat pipes with different working fluids therein.

Furthermore, it is to be understood that the primary fluid, which will ordinarily be at a higher temperature than the secondary fluid, can pass over the top, bottom or sides of the heat pipe, and need not pass over the heat pipe from the bottom of the heat pipe, as shown in FIG. 1.

The heat pipes 56 are attached to the walls 14 and 32 at the location of their penetration therethrough, such that each chamber 12, 30 and 45 is gas-tight.

It is to be understood that the pressures within chamber 12, 30 and 45 may be different. In the event that primary or secondary fluid were to leak into chamber 45, for example at the locations of the penetration of heat pipes 56, through walls 14 or 32, this leakage would be carried in the purge fluid stream flowing through vent line 52. Analyzer 58 is provided to detect the presence of any leakage, and through conventional means a warning signal would be generated.

In the event that primary or secondary fluid were to leak into heat pipe 56, or if the working fluid of heat pipe 56 were to leak from heat pipe 56, thermocouples 60 are provided to detect a change in operation of any heat pipe 56. A signal is generated in a conventional manner which would indicate such change in operation. Thermocouples 56 can be located within the first chamber as shown in FIG. 1, within the third chamber, as shown in FIG. 3, or within the second chamber. The thermocouples are of a known type, and are connected to a sensing device 62, such as an oscillograph, by way of electrical leads 64.

In FIGS. 3 and 4 there is shown an alternative arrangement of the heat exchanger of the present invention. A 100 series of reference numerals has been provided for designating elements which correspond to those elements previously discussed.

In this arrangement a first chamber 112 and a second chamber 130 are disposed within a purge fluid chamber 145. In this arrangement, however, inlet pipes 126 and 140 have expansion sections 127 and 141, respectively, while outlet pipes 120 and 144 have expansion sections 121 and 159 respectively. Inlet pipe 140 and outlet pipe 120 penetrate a top closure 150 of chamber 145 and are attached thereto to maintain chamber 145 as a gas-tight enclosure. Similarly, outlet pipe 144 and inlet pipe 126 penetrate bottom closure 153, being welded thereto to maintain chamber 145 as a gas-tight enclosure. Purge fluid passes to chamber 146 from inlet 155, and is removed through line 152.

It should be understood that the flow of purge fluid through chamber 46, 146 may be maintained at a relatively low rate in order to minimize heat loss from heat pipe 56 to the purge fluid. Alternatively, the intermediate portion of the heat pipe could be insulated so as to minimize heat loss from heat pipe 56 to the purge fluid. A further alternative for minimizing heat loss from the heat pipe 56 to the purge fluid would be to alter the heat pipe geometry so as to minimize heat transfer surface of the heat pipe exposed to the purge fluid.

In operation, primary fluid at a given temperature is passed through inlet pipe 26, 126 into first chamber 12, 112. Simultaneous with the passage of primary fluid into chamber 12, 112 secondary fluid at a different temperature from that of the primary fluid is passed through inlet 40, 140 into second chamber 30, 130. As the fluids flow over heat pipes 56, 156, heat is transferred from the hotter fluid, through the heat pipe, and then to the cooler fluid thereby cooling the hotter fluid. The primary and secondary fluids are thereafter removed from chambers 12, 112 and 30, 130 respectively through outlet pipes 20, 120 and 44, 144 respectively. In the event that leakage of primary or secondary fluid into purge fluid chamber 46, 146, occurs, the leakage is conveyed in the purge fluid stream passing through vent pipe 52, 152. Thereafter, leakage is detected by analyzer 58, 158. If primary or secondary fluid were to leak into heat pipe 56, 156, or if working fluid were to leak out of heat pipe 56, 156, thermocouple 60, 160 will detect the change in operation of this heat pipe experiencing leakage, and generate a signal through leads 164. Sensing device 162 will indicate this change of operation; for example, device 162 may be an oscillograph.

A latitude of modification, change, and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A heat exchanger comprising; a first fluid chamber for maintaining flow of a primary fluid; a second fluid chamber for maintaining flow of a secondary fluid, said second chamber spaced apart from said first chamber; a heat pipe including a cylindrical member closed at the ends thereof to contain a working fluid therein, said heat pipe extending in said first chamber and second chamber and having a portion between said chambers; a third fluid chamber for maintaining flow of a purged fluid, said portion of said heat pipe positioned within said third chamber, said chamber including side walls, a top closure, a bottom closure, inlet means for introducing said third fluid and outlet means for removing said third fluid; means for detecting leakage of said primary or said secondary fluid into said heat pipe and leakage of said working fluid from said heat pipe; and means for detecting primary or secondary fluid in said third chamber, whereby primary or secondary fluid leaking from said first and second chambers into said third chamber which is carried in said purged fluid is detected.

2. The heat exchanger of claim 1 further comprising a plurality of heat pipes having a working fluid disposed therein and extending from inside said first chamber to inside said second chamber, each of said heat pipes having a portion between said chamber.

3. The heat exchanger of claim 1 wherein said side walls of said third chamber include two walls being defined by portions of said first and second fluid chambers, and two other walls extending therebetween.

4. The heat exchanger of claim 3 further comprising expansion joints in said walls extending between said walls defined by said first and said second fluid chambers.

5. The heat exchanger of claim 3 wherein said side walls of said third chamber comprise an outer shell, said first and second chambers being disposed within said shell, said shell having openings for passing said primary and secondary fluids to and from said first and second chambers respectively.

6. The heat exchanger of claim 5 further comprising means for allowing longitudinal expansion of said first and said second chamber.

7. The heat exchanger of claim 1 wherein said first and second chambers are of circular cross-section.

8. The heat exchanger of claim 1 wherein said first and second chambers are of rectangular cross-section.

* * * * *